US008800516B2

(12) United States Patent
Kobayashi et al.

(10) Patent No.: US 8,800,516 B2
(45) Date of Patent: Aug. 12, 2014

(54) VARIABLE VALVE TIMING CONTROL APPARATUS

(71) Applicant: Aisin Seiki Kabushiki Kaisha, Kariya (JP)

(72) Inventors: Masaki Kobayashi, Okazaki (JP); Kazunari Adachi, Chiryu (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 0 days.

(21) Appl. No.: 13/829,079

(22) Filed: Mar. 14, 2013

(65) Prior Publication Data

US 2013/0312680 A1 Nov. 28, 2013

(30) Foreign Application Priority Data

May 25, 2012 (JP) ..... 2012-119958

(51) Int. Cl.
*F01L 1/34* (2006.01)

(52) U.S. Cl.
USPC ..... 123/90.17

(58) Field of Classification Search
CPC . F01L 1/344; F01L 1/3442; F01L 2001/3443; F01L 1/34
See application file for complete search history.

(56) References Cited

U.S. PATENT DOCUMENTS 6,318,319 B1 * 11/2001 Miyasaka et al. ..... 123/90.17
6,802,289 B2 10/2004 Miyazaka et al.
2003/0168032 A1 * 9/2003 Miyazaka et al. ..... 123/90.17
2007/0251475 A1 * 11/2007 Suga et al. ..... 123/90.17
2011/0162606 A1 7/2011 Kaneko

FOREIGN PATENT DOCUMENTS

JP 3986331 B2 10/2007
JP 2010-223172 A 10/2010

* cited by examiner

*Primary Examiner* — Thomas Denion
*Assistant Examiner* — Daniel Bernstein
(74) *Attorney, Agent, or Firm* — Buchanan Ingersoll & Rooney PC

(57) ABSTRACT

A variable valve timing control apparatus includes a driving side rotation member synchronously rotating with a crankshaft of an internal combustion engine, a driven side rotation member including a rotation peripheral surface, an intermediate lock mechanism for locking a rotational phase of the driven side rotation member at an intermediate phase between a most retarded angle phase and a most advanced angle phase, and a fixed member fixed to the internal combustion engine and including a fixed peripheral surface facing the rotation peripheral surface of the driven side rotation member. Plural seal rings each formed in an annular shape are positioned between the rotation peripheral surface of the driven side rotation member and the fixed peripheral surface of the fixed member, the seal rings positioned spaced apart from each other by a predetermined distance. The seal ring sandwiched between two of a communication portion for advanced angle, a communication portion for retarded angle, and a communication portion for lock in a direction of the rotational axis among the plural seal rings includes a communication passage which establishes constant communication between both sides thereof in association with the direction of the rotational axis when temperature of the pressurized fluid is within a temperature range which allows a control of the rotational phase of the driven side rotation member.

8 Claims, 4 Drawing Sheets

VARIABLE VALVE TIMING CONTROL APPARATUS

TECHNICAL FIELD

This disclosure generally relates to a variable valve timing control apparatus.

BACKGROUND DISCUSSION

According to the variable valve timing control apparatus, a rotational phase of a driven side rotation member relative to a driving side rotation member can be varied towards an advancing angle side by draining a fluid in a retarded angle chamber while incrementing a volume of an advanced angle chamber by a pressurized fluid supplied to an advanced angle fluid passage, and the rotational phase can be varied towards a retarded angle side by draining the fluid in the advanced angle chamber while incrementing a volume of the retarded angle chamber by the pressurized fluid supplied to a retarded angle fluid passage. Further, for example, the rotational phase of the driven side rotation member relative to the driving side rotation member can be locked at an intermediate phase between a most retarded angle phase and a most advanced angle phase so that an opening and closing timing of an intake valve or an exhaust valve is assumed to be an optimum timing for starting an engine.

JP2010-223172A discloses a variable valve timing control apparatus in which three fluid passages each supplying a pressurized fluid to an advanced angle fluid passage, a retarded angle fluid passage, and a lock fluid passage provided at a driven side rotation member are open to a fixed peripheral surface of a fixed member sliding relative to a rotational peripheral surface of the driven side rotation member. In a case where the pressurized fluid supplied from the fluid passages leaks via a sliding surface between the rotational peripheral surface and the fixed peripheral surface, there is a possibility that a switching operation of a lock member and a change in a valve opening-closing timing cannot be performed at an appropriate timing. Accordingly, it is necessary to machine process the rotational peripheral surface and the fixed peripheral surface with high precision so as not to cause leakages of the fluid via the sliding surface, which is likely to increase manufacturing costs.

JP3986331B discloses a variable valve timing control apparatus which includes an advanced angle fluid passage and a retarded angle fluid passage provided at a driven side rotation member and two fluid passages each supplying a pressurized fluid to the advanced angle fluid passage and the retarded angle fluid passage. The advanced angle fluid passage and the retarded angle fluid passage are in communication with two fluid passages each supplying the pressurized fluid to the advanced angle fluid passage and the retarded angle fluid passage, respectively, via a communication portion for retarded angle and a communication portion for advanced angle, respectively, which are formed annularly by dividing a void between the rotational peripheral surface of the driven side rotation member and the fixed peripheral surface of the fixed member by means of seal rings. Thus, leakages of the fluid provided between the rotational peripheral surface and the fixed peripheral surface can be prevented by the seal ring without machining the rotational peripheral surface and the fixed peripheral surface with high precision, that is, while adopting a structure which is unlikely to increase manufacturing costs.

Here, it is considered to establish a communication between each of the advanced angle fluid passage, the retarded angle fluid passage, and the lock fluid passage and each of three fluid passages for supplying the pressurized fluid to the advanced angle fluid passage, the retarded angle fluid passage, and the lock fluid passage, respectively, via a communication passage for advanced angle, a communication passage for retarded angle, and a communication passage for lock which are formed by annularly dividing a void provided between a rotational peripheral surface and a fixed peripheral surface by means of seal rings for the variable valve timing control apparatus disclosed in JP2010-223172A in order to perform the switching operation of the lock member and to change in the valve opening-closing timing at appropriate timing while adopting a structure which is unlikely to increase manufacturing costs.

However, for example, provided that the communication portion for lock is positioned between the communication portion for advanced angle and the communication portion for retarded angle, the sealing dividing, or defining the communication portion for lock and the communication portion for advanced angle, and the seal ring dividing, or defining the communication portion for lock and the communication portion for retarded angle may be deformed and damaged.

That is, when the pressurized fluid is supplied to the advanced angle fluid passage or the retarded angle fluid passage in a state where the pressurized fluid is not supplied to the lock fluid passage, the seal ring is urged to displace towards the communication portion for lock by a fluid pressure in the communication portion for advanced angle or in the communication portion for retarded angle. Further, when the pressurized fluid is supplied to the lock fluid passage in a state where the pressurized fluid is not supplied to the advanced angle fluid passage and the retarded angle fluid passage, the seal ring is urged to displace towards the communication portion for advanced angle or the communication portion for retarded angle by the fluid pressure in the communication portion for lock. Still further, even when the pressurized fluid is simultaneously supplied to the advanced angle fluid passage or the retarded angle fluid passage, and to the lock fluid passage by a common fluid pump, there is a case that fluid pressure level between the communication portion for advanced angle or the communication portion for the retarded angle and the communication portion for lock slightly differ from each another due to differences in pressure loss, and the seal ring is urged to displace towards the communication portion for advanced angle or the communication portion for retarded angle, or towards the communication portion for lock in response to the pressure difference therebetween.

Because flexural rigidity of the seal ring in a rotational axis direction is not necessarily even because of slight dispersion of machining precision and an accuracy of dimension along a circumferential direction of the seal ring, the displacement of the seal ring is assumed to be uneven in the circumferential direction, and may be increased within a particular range in the circumferential direction. Because the supply of the pressurized fluid to the advanced angle fluid passage or the retarded angle fluid passage and the supply of the pressurized fluid to the lock fluid passage are repeated as necessity arises, the seal ring may eventually be damaged by fatigue because of deformation.

SUMMARY

A variable valve timing control apparatus disclosed here includes a driving side rotation member synchronously rotating with a crankshaft of an internal combustion engine, a driven side rotation member positioned to be coaxially rotatable relative to the driving side rotation member about a common rotational axis, synchronously rotating with a camshaft for opening and closing a valve of the internal combustion engine, and including a rotation peripheral surface, a fluid pressure chamber formed between the driving side rotation member and the driven side rotation member, an advanced angle chamber and a retarded angle chamber formed by dividing the fluid pressure chamber by a dividing portion provided at least one of the driving side rotation member and the driven side rotation member, a phase control portion for controlling a rotational phase of the driven side rotation member relative to the driving side rotation member by supplying a pressurized fluid to the advanced angle chamber or to the retarded angle chamber, an intermediate lock mechanism including a lock fluid passage allowing an inflow of the pressurized fluid and a lock member allowing a switching of a locked state where the rotational phase of the driven side rotation member is locked at an intermediate phase between a most retarded angle phase and a most advanced angle phase and an unlocked state where the locked state is released by a fluid pressure of the pressurized fluid flowing in from the lock fluid passage, the driven side rotation member including an advanced angle fluid passage, which is in communication with the advanced angle chamber, a retarded angle chamber, which is in communication with the retarded angle chamber, and the lock fluid passage, a fixed member formed with a fixed peripheral surface facing the rotation peripheral surface of the driven side rotation member in a standstill state, positioned coaxially to an axis of the driven side rotation member, and including a plurality of fluid passages opening to the fixed peripheral surface to allow a supply of the pressurized fluid to an advanced angle fluid passage, a retarded angle fluid passage, and a lock fluid passage, plural seal rings each formed in an annular shape and positioned between the rotation peripheral surface of the driven side rotation member and the fixed peripheral surface of the fixed member, the seal rings positioned spaced apart from each other by a predetermined distance, the advanced angle fluid passage, the retarded angle fluid passage, and the lock fluid passage are in communication with the corresponding fluid passages via a communication portion for advanced angle, a communication portion for retarded angle, and a communication portion for lock formed by annularly defining a void between the rotation peripheral surface and the fixed peripheral surface by the corresponding seal rings, respectively. The seal ring sandwiched between two of the communication portion for advanced angle, the communication portion for retarded angle, and the communication portion for lock in a direction of the rotational axis among the plural seal rings includes a communication passage which establishes constant communication between both sides thereof in association with the direction of the rotational axis when temperature of the pressurized fluid is within a temperature range which allows a control of the rotational phase of the driven side rotation member.

DETAILED DESCRIPTION

Embodiments of a variable valve timing control apparatus disclosed here will be explained with reference to Figures.

First Embodiment

Figure 1:
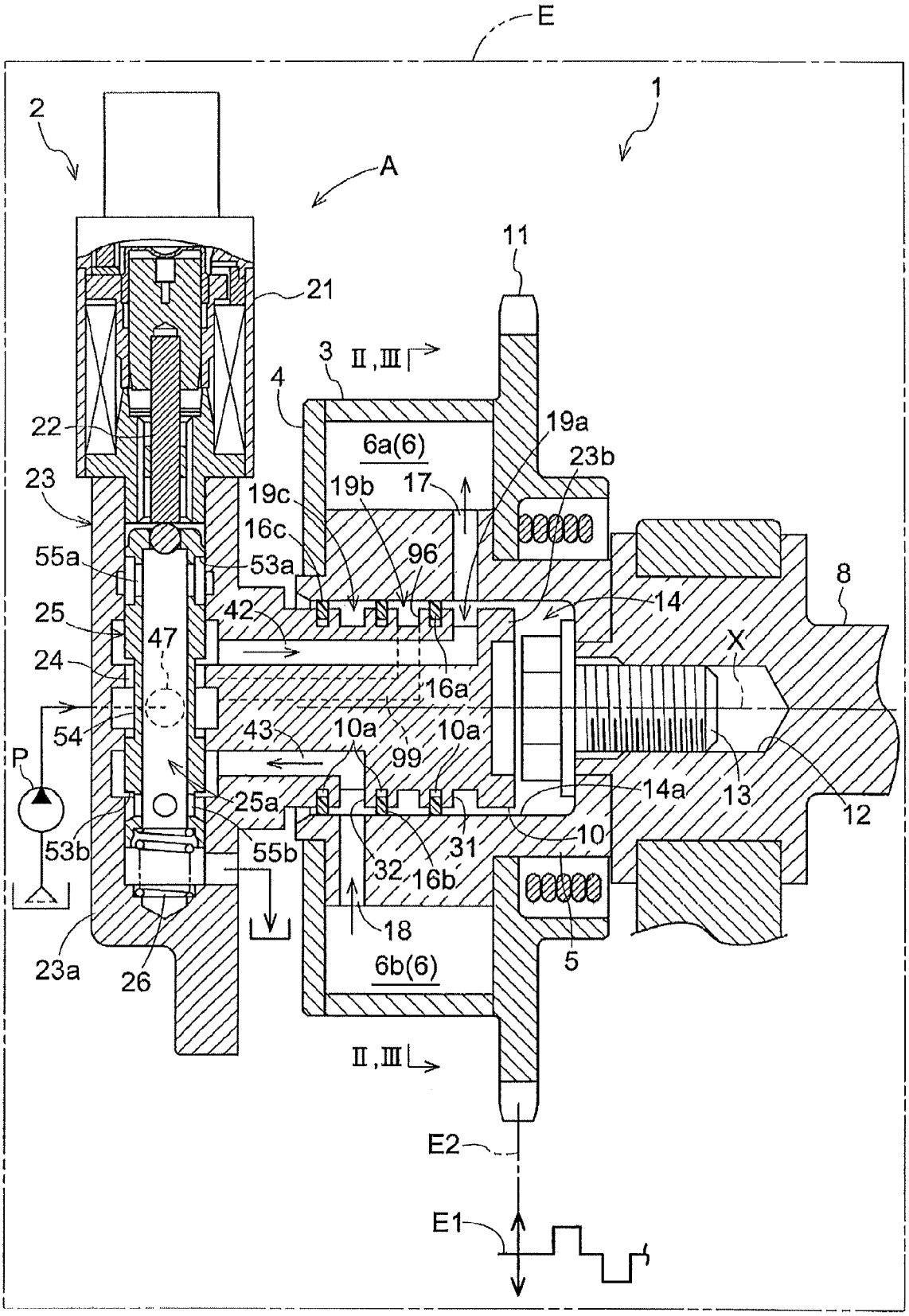
FIG. 1 is a cross-sectional view of a variable valve timing control apparatus in a rotational axis direction at a fluid control valve side.
Figure 2:
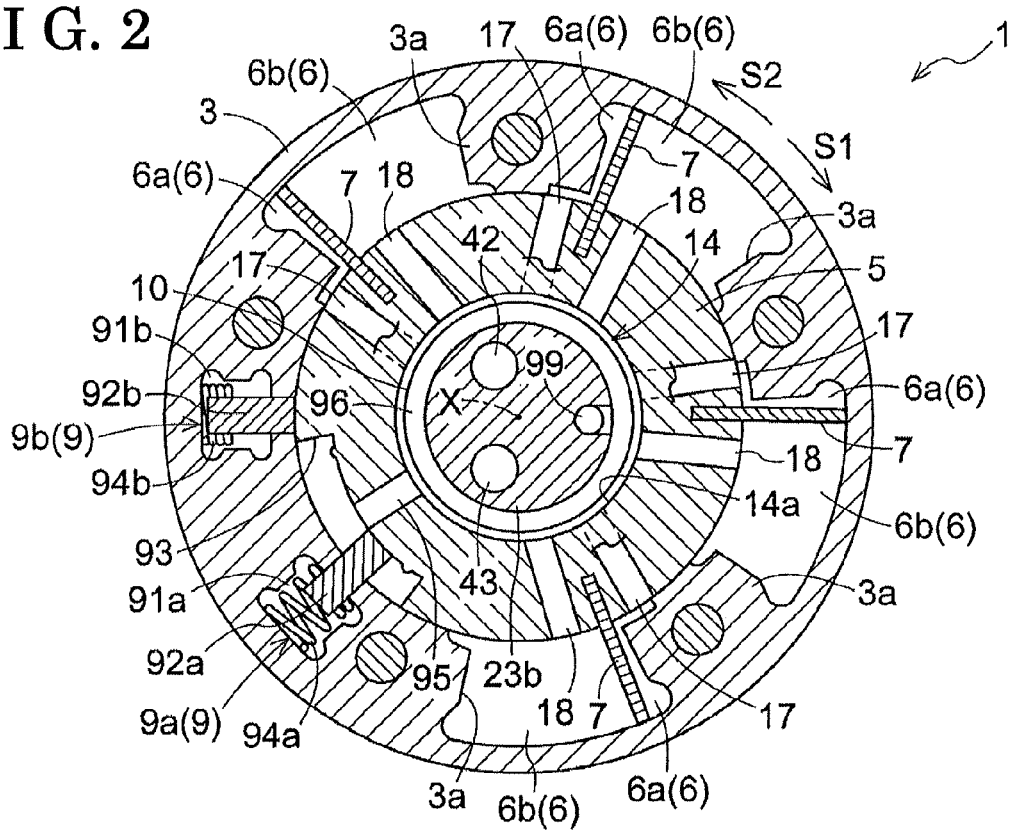
FIG. 2 is a cross-sectional view taken on line II-II in FIG. 1.
Figure 3:
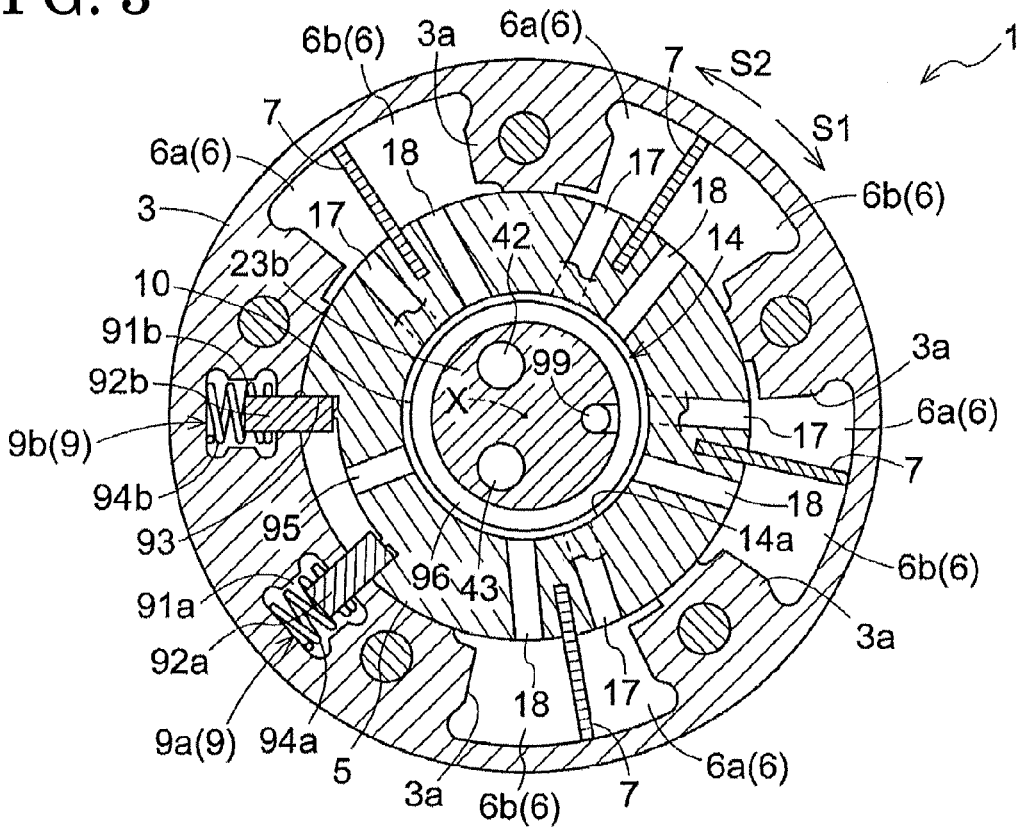
FIG. 3 is a cross-sectional view taken on line III-III in FIG. 1.

As shown in FIGS. 1 to 3, a variable valve timing control apparatus 1 includes an outer rotor 3 and a front plate 4 which serve as a driving side rotation member synchronously rotating with a crankshaft E1 of a vehicle gasoline engine (internal combustion engine) E, and an inner rotor 5 serving as a driven side rotation member. The inner rotor 5 is positioned to be coaxially rotatable relative to the outer rotor 3 about a rotational axis X, and synchronously rotates with a camshaft 8 for opening and closing valves for an engine. The outer rotor 3 and the inner rotor 5 are formed annularly.

The inner rotor 5 is integrally mounted to an end portion of the camshaft 8 including a cam (not shown) for controlling an opening and closing of an intake valve or an exhaust valve of the engine. The inner rotor 5 is formed with a recessed portion 14 which includes an inner peripheral surface 14*a* formed in a cylindrical configuration to be coaxial to the rotational axis X. The inner rotor 5 and the camshaft 8 are integrally fixed by screwing a bolt 13 into a female screw hole 12 formed at a bottom surface of the recessed portion 14. The camshaft 8 is rotatably assembled to a cylinder head (not shown) of the engine.

The outer rotor 3 is integrally assembled with the front plate 4 to be rotatable relative to the inner rotor 5 within a predetermined angular range. A sprocket portion 11 is provided at an outer periphery of the outer rotor 3 coaxially with the outer rotor 3. A power transmission member E2, for example, a timing chain or a timing belt is wound around and spanning the sprocket portion 11 and a gear (not shown) mounted to the crankshaft E1.

Upon the rotational actuation of the crankshaft E1, a rotational force, or a torque is transmitted to the sprocket portion 11 via a power transmission member E2 to rotate the outer rotor 3. When the camshaft 8 is rotated by a driven rotation of the inner rotor 5 in accordance with the rotational actuation of the outer rotor 3, the cam provided at the camshaft 8 pushes the intake valve or the exhaust valve downward to open.

Figure 4:
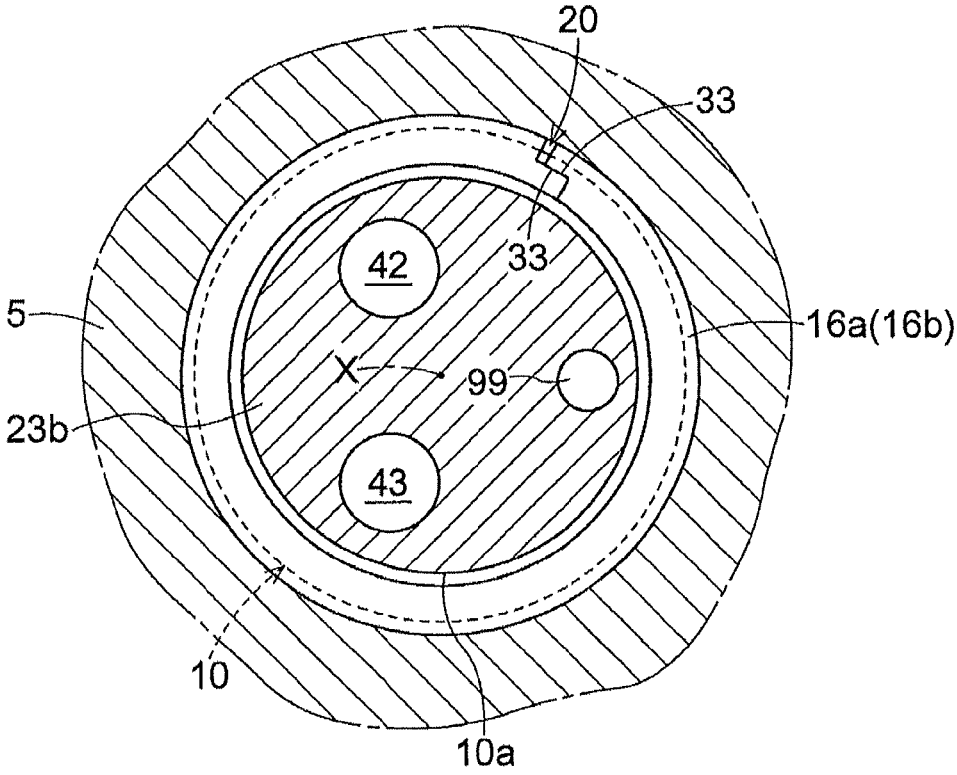
FIG. 4 is a cross-sectional view showing a state where a seal ring is attached.

As illustrated in FIGS. 3 and 4, plural protrusion portions 3*a* protruding inwardly in a radial direction are integrally formed at an inner side of the outer rotor 3 at positions spaced apart from each other in a circumferential direction. Four fluid pressure chambers 6 are formed between the outer rotor 3 and the inner rotor 5 and between the protrusion portions 3*a* which are positioned adjacent to each other in the circumferential direction.

A groove is formed on the outer peripheral portion of the inner rotor 5 at a portion facing each of the fluid pressure chambers 6, and a vane 7 serving as a dividing portion is provided in each of the grooves. The fluid pressure chamber 6 is divided into an advanced angle chamber 6*a* and a retarded angle chamber 6*b* positioned in a front-rear arrangement in the circumferential direction (arrowed directions S1, S2 in FIGS. 2 and 3) by the vane 7.

The inner rotor 5 is formed with an advanced angle fluid passage 17 for establishing a communication between the recessed portion 14 and the advanced angle chamber 6*a*, and a retarded angle fluid passage 18 for establishing a communication between the recessed portion 14 and the retarded angle chamber 6*b*.

By supplying operation oil serving as a pressurized fluid outputted from a pump P to the advanced angle chamber 6*a* or to the retarded angle chamber 6*b*, a relative rotational phase of the inner rotor 5 relative to the outer rotor 3 is displaced towards an advanced angle direction S1 or towards a retarded angle direction S2. The direction of the advanced angle direction S1 shows a direction indicated with an arrow S1 and the retarded angle direction S2 shows a direction indicated with an arrow S2 shown in FIGS. 3 and 4.

When the operation oil is supplied to the advanced angle chamber 6*a*, the operation oil of the retarded angle chamber 6*b* internal combustion engine is drained while incrementing the volume of the advanced angle chamber 6*a* to displace the relative rotational phase towards the advanced angle direction S1 On the other hand, when the operation oil is supplied to the retarded angle chamber 6*b*, the operation oil in the advanced angle chamber 6*a* is drained while incrementing the volume of the retarded angle chamber 6*b* to displace the relative rotational phase towards the retarded angle direction S2. An angular range in which the relative rotational phase is displaceable corresponds to a range in which the vane 7 is displaceable inside the fluid pressure chamber 6, and corresponds to an angular range between a most advanced angle phase at which the volume of the retarded angle chamber 6*b* is maximized and a most advanced angle phase at which the volume of the advanced angle chamber 6*a* is maximized.

A fluid control valve mechanism A configures a phase control portion for controlling the relative rotational phase of the inner rotor 5 relative to the outer rotor 3 by supplying the operation oil to the advanced angle chamber 6*a* or to the retarded angle chamber 6*b*. The fluid control valve mechanism A includes a fluid control valve portion 2. In response to an operation of the fluid control valve portion 2, the supply of the operation oil to the advanced angle chamber 6*a* or to the retarded angle chamber 6*b* or the draining of the operation oil from the advanced angle chamber 6*a* or from the retarded angle chamber 6*b* is selectively controlled.

The fluid control valve mechanism A integrally includes a housing 23 provided at the fluid control valve portion 2 and a fixed member 23*b* formed in a cylindrical shape and coaxially positioned in the recessed portion 14 of the inner rotor 5 to be relatively rotatable. The fixed member 23*b* is formed with a fixed outer peripheral surface 10 coaxially facing the inner peripheral surface 14*a* of the recessed portion 14 which corresponds to a rotation peripheral surface of the inner rotor 5 in a standstill state. The fixed member 23*b* is fixed to, for example, a front cover of the engine E via the housing 23.

As shown in FIG. 1, the fluid control valve portion 2 includes a solenoid 21, a housing 23, and a spool 25. The spool 25 is formed in a cylindrical configuration having a bottom, which includes a hollow portion 25*a*. The housing 23 is provided with a first spool housing portion 23*a*, which includes a hollow portion 24, integrally with the fixed member 23*b*. The spool 25 is housed within the hollow portion 24 of the first spool housing portion 23*a* to be movable in a spool axial direction which is orthogonal to the rotational axis X of the inner rotor 5.

A compression spring 26 for biasing the spool 25 towards an opening of the hollow portion 24 is mounted between the spool 25 and a bottom surface of the hollow portion 24. The solenoid 21 provided with a rod 22 for reciprocating the spool 25 in an axial direction of the spool 25 is mounted to an end portion of an opening of the first spool housing portion 23*a*.

When electrifying the solenoid 21, the rod 22 is moved to protrude to push a bottom portion of the spool 25, and the spool 25 is moved downwardly in FIG. 1 against the biasing force of the compression spring 26. When stopping electrifying the solenoid 21, the rod 22 is moved and the spool 25 is moved towards the solenoid 21 by the biasing force of the compression spring 26. The solenoid 21, the rod 22, the spool 25, and the compression spring 26 configure the fluid control valve portion 2.

The advanced angle fluid passage 17, the retarded angle fluid passage 18, and a lock fluid passage 95 described hereinafter are open to the inner peripheral surface 14*a* of the recessed portion 14. The fixed member 23*b* includes an advanced angle side fluid passage 42, a retarded angle side fluid passage 43, and a passage 99 for lock operation described hereinafter which serve as plural fluid passages (a plurality of fluid passages) for supplying the operation oil to the advanced angle fluid passage 17, the retarded angle fluid passage 18, and the lock fluid passage 95, respectively. The advanced angle side fluid passage 42, the retarded angle side fluid passage 43, and the passage 99 for lock operation are open to the fixed outer peripheral surface 10.

That is, an outer peripheral groove 31 for advanced angle, an outer peripheral groove 32 for retarded angle, and an outer peripheral groove 96 for lock operation each of which are formed in an annular shape are formed on the fixed outer peripheral surface 10 over the entire circumstance to be in parallel to one another, and the outer peripheral groove 96 for lock operation is positioned between the outer peripheral groove 31 for advanced angle and the outer peripheral groove 32 for retarded angle. The advanced angle side fluid passage 42 opens to a groove bottom surface of the outer peripheral groove 31 for advanced angle, the retarded angle side fluid passage 43 opens to a groove bottom surface of the outer peripheral groove 32 for retarded angle, and the passage 99 for lock operation opens to a groove bottom surface of the outer peripheral groove 96.

Two seal rings 16*a*, 16*b* made of resin, or made of rubber and dividing, or defining the adjacent outer peripheral grooves 31, 96, 32, and a seal ring 16*c* dividing, or defining the outer peripheral groove 32 and an outside of the apparatus are mounted between the inner peripheral surface 14*a* of the recessed portion 14 and the fixed outer peripheral surface 10. Each of the seal rings 16*a* to 16*c* is attached to an annular groove 10*a* formed on the fixed outer peripheral surface 10. The advanced angle fluid passage 17, the retarded angle fluid passage 18, and the lock fluid passage 95 which are open to the inner peripheral surface 14*a* of the recessed portion 14 are in communication with corresponding fluid passages 42, 99, 43, respectively, via a communication portion 19*a* for advanced angle, a communication portion 19*c* for retarded angle, and a communication portion 19*b* for lock positioned between the communication portion 19*a* for advanced angle side and the communication portion 19*c* for retarded angle which are divided, or defined by three seal rings 16*a* to 16*c*. Particularly, the advanced angle fluid passage 17 is communicated with the advanced angle side fluid passage 42 via the communication portion 19*a* for advanced angle, the lock fluid passage 95 is communicated with the fluid passage 99 for lock operation via the communication portion 19*b* for lock, and the retarded angle fluid passage 18 is communicated with the retarded angle side fluid passage 43 via the communication passage 91*c* for retarded angle.

Figure 5:
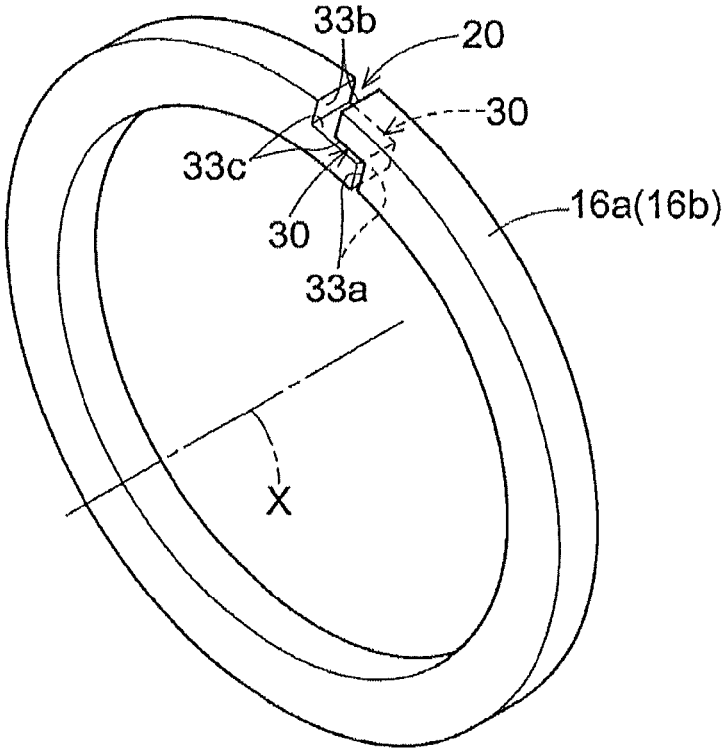
FIG. 5 is a perspective view of the seal ring.

As illustrated in FIGS. 4 and 5, a communication passage 20 formed in a U-shape in cross section is provided at each of the seal ring 16*a*, which is sandwiched between the communication portion 19*a* for advanced angle and the communication portion 19*b* for lock, and the seal ring 16*b* sandwiched between the communication portion 19*b* for lock and the communication portion 19*c* for retarded angle. The communication passage 20 is provided at an outer peripheral side and at an inner peripheral side and is constantly in communication with both sides in the rotational axis X direction in a temperature range of the operation oil in which the rotational phase is controllable. The seal rings 16*a*, 16*b* are positioned between two of the communication portion 19*a* for advanced angle, the communication portion 19*c* for retarded angle, and the communication portion 19*b* for lock in the rotational axis X direction, and the oil pressure affects the seal rings 16*a*, 16*b* from the both sides in the rotational axis X direction.

The seal rings 16*a*, 16*b* are formed in a C-shape in a planar view and are formed to have a quadrilateral shape in cross section. Each of the seal rings 16*a*, 16*b* includes a pair of end surfaces 33 which faces each other to selectively contact each other, that is, to contact each other or separate from each other at a portion in a circumferential direction from a direction orthogonal to the rotational axis X. As shown in FIG. 5, each of the end surfaces 33 is formed in a stepwise configuration when viewed from a direction orthogonal to the rotational axis X, where two radial direction end surfaces 33*a*, 33*b* arranged along a radial direction of the ring formed at the ring outer peripheral side and the ring inner peripheral side keeping a distance in a ring circumferential direction are connected via a circumferential direction end surface 33*c* arranged along the ring circumferential direction and formed along an intermediate portion in a ring thickness direction.

Each of the seal rings 16*a*, 16*b* is fitted into the annular groove 10*a* in a manner that the radial direction end surfaces 33*a* at the ring inner peripheral side tightly contact each other, the radial direction end surfaces 33*b* at the ring outer peripheral side are slightly separated from each other in the circumferential direction, and the circumferential direction end surfaces 33*c* tightly contact each other to provide the communication passage 20 formed by a clearance between the radial direction end surfaces 33*b* at the ring outer peripheral side. Alternatively, in addition to the communication passage 20 formed by the clearance between the radial direction end surfaces 33*b* of the ring outer peripheral side, a communication passage may be formed by a clearance between the radial direction end surfaces 33*a* at the ring inner peripheral side by mounting the seal ring 16*a*, 16*b* so that the radial direction end surfaces 33*a* at the ring inner peripheral side are slightly separated from each other in the circumferential direction.

Thus, in the temperature range of the operation oil which allows a control for the rotational phase by the actuation of the variable valve timing control apparatus, for example, in the temperature range from 60° C. to 120° C., the operation oil in one of the communication portion 19*a* for advanced angle, the communication portion 19*c* for retarded angle, and the communication portion 19*b* for lock is relieved to the adjoining communication portion via the communication passage 20 to reduce a pressure difference between the communication portion 19*a* for advanced angle or the communication portion 19*c* for retarded angle, and the communication portion 19*b* for lock, and thus the displacement of the seal rings 16*a*, 16*b* towards the communication portion 19*a* for advanced angle and the communication portion 19*c* for retarded angle, respectively, or towards the communication portion 19*b* for lock can be reduced.

As shown in FIG. 1, the housing 23 is formed with a supply side fluid passage 47 which is in communication with the hollow portion 24 of the first spool housing portion 23*a* along the direction orthogonal to the spool 25. The supply side fluid passage 47 supplies the operation oil from the pump P to the hollow portion 24. The advanced angle side fluid passage 42 and the retarded angle side fluid passage 43 are in communication with the hollow portion 24.

Annular outer peripheral grooves 53*a*, 53*b* for draining and an outer peripheral groove 54 for supplying are formed over the entire circumference of the outer peripheral surface of the spool 25. The outer peripheral grooves 53*a*, 53*b* for draining are in communication with the hollow portion 25*a* of the spool 25 via through holes 55*a*, 55*b*, respectively.

As shown in FIG. 1, in a state where the solenoid 21 is not electrified, or not energized the outer peripheral groove 54 for supplying is in communication with the supply side fluid passage 47 and the advanced angle side fluid passage 42, and the outer peripheral groove 53*b* for draining is in communication with the retarded angle side fluid passage 43. On the other hand, when the solenoid 21 is electrified, or energized, the outer peripheral groove 54 for supplying is in communication with the supply side fluid passage 47 and the retarded angle side fluid passage 43 and the outer peripheral groove 53*a* for draining is in communication with the advanced angle side fluid passage 42.

As shown in FIGS. 2 and 3, lock members 92*a*, 92*b*, which are configured to switch a locked state where the relative rotational phase of the inner rotor 5 relative to the outer rotor 3 are locked at an intermediate phase (see FIG. 3) between the most retarded angle phase and the most advanced angle phase and an unlocked state where the locked state is released, are provided between the outer rotor 3 and the inner rotor 5. The lock fluid passage 95 allows an inflow of the operation oil into between the recessed portion 14 of the inner rotor 5 and a recessed portion 93 for locking. The lock members 92*a*, 92*b* are switched to the locked state and to the unlocked state in accordance with a level of the fluid pressure of the operation oil introduced via the lock fluid passage 95.

An intermediate lock mechanism 9 includes a lock housing portion 91*a*, 91*b*, a lock member 92*a*, 92*b*, the recessed portion 93 for locking which is in communication with the lock fluid passage 95, and a spring 94*a*, 94*b*. The lock housing portions 91*a*, 91*b* are formed on the outer rotor 3. The lock fluid passage 95 and the recessed portion 93 for locking are formed on the inner rotor 5. The lock member 92*a*, 92*b* is displaceable between the locked state where the lock member 92*a*, 92*b* moves into the recessed portion 93 for locking to lock the rotation of the inner rotor 5 relative to the outer rotor 3 and the unlocked state where the lock member 92*a*, 92*b* moves into the lock housing portion 91*a*, 91*b* from the recessed portion 93 for locking. The lock member 92*a*, 92*b* is normally biased to protrude towards the recessed portion 93 for locking by the spring 94*a*, 84*b* provided at the lock housing portion 91*a*, 91*b*.

[Operation of Variable Valve Timing Control Apparatus]

As shown in FIG. 1, when displacing the relative rotational phase in the advanced angle direction S1 by supplying the operation fluid to the advanced angle chamber 6*a*, a non-energized state where the solenoid 21 of the fluid control valve portion 2 is not electrified is established. In those circumstances, by the biasing force of the compression spring 26, the spool 25 moves towards the solenoid 21 together with the rod 22 of the solenoid 21. Upon supplying the operation fluid to the supply side fluid passage 47 from the pump P in the non-energized state, as shown in FIGS. 1 and 2, the operation oil is sent to each of the advanced angle chambers 6*a* with pressure from the supply side fluid passage 47 via the outer peripheral groove 54 for supplying, the advanced angle side fluid passage 42, the communication portion 19*a* for advanced angle, and the advanced angle fluid passage 17. In those circumstances, the vane 7 relatively moves in the advanced angle direction S1 and the operation oil in each of the retarded angle chambers 6*b* is drained. The operation oil is drained to the outside from each of the retarded angle chambers 6*b* via each of the retarded angle fluid passages 18, the communication portion 19*c* for retarded angle, the retarded angle side fluid passage 43, the outer peripheral groove 53*a* for draining, the through hole 55*a*, and a draining passage (not shown).

On the other hand, in case of displacing the relative rotational phase in the retarded angle direction S2 by supplying the operation oil to the retarded angle chamber 6*b*, the solenoid 21 of the fluid control valve portion 2 is electrified. In those circumstances, the spool 25 is pushed to move downwardly by the rod 22 of the solenoid 21. Upon supplying the operation oil from the pump P to the supply side fluid passage 47 in the energized state, the operation oil is sent to the retarded angle chamber 6*b* with pressure from the pump P via the supply side fluid passage 47, the outer peripheral groove 54 for supplying, the retarded angle side fluid passage 43, the communication portion 19*c* for retarded angle, and the retarded angle fluid passage 18. In those circumstances, the vane 7 relatively moves in the retarded angle direction S2 to drain the operation fluid in each of the advanced angle chambers 6*a*. The operation fluid is drained to the outside from each of the advanced angle chambers 6*a* via the advanced angle fluid passage 17, the communication portion 19*a* for advanced angle, the advanced angle side fluid passage 42, the outer peripheral groove 53*b* for draining, the through hole 55*b*, and a draining fluid passage (not shown).

The intermediate lock mechanism 9 is switched to the locked state where the lock member 92*a*, 92*b* enters the recessed portion 93 for lock to lock the relative rotational phase of the inner rotor 5 relative to the outer rotor 3 at the intermediate phase. When the engine is activated, the operation oil is supplied to the fluid passage 99 for lock operation from an accumulator (not shown), the lock member 92*a*, 92*b* retracts from the recessed portion 93 for locking to the lock housing portion 91*a*, 91*b*, so that the intermediate lock mechanism 9 is switched to the unlocked state.

The variable valve timing control apparatus disclosed here is particularly effective for an engine having a large fluctuation torque of a cam, for example, a three-cylinder engine or a V-type six cylinder engine.

Second Embodiment

Figure 6:
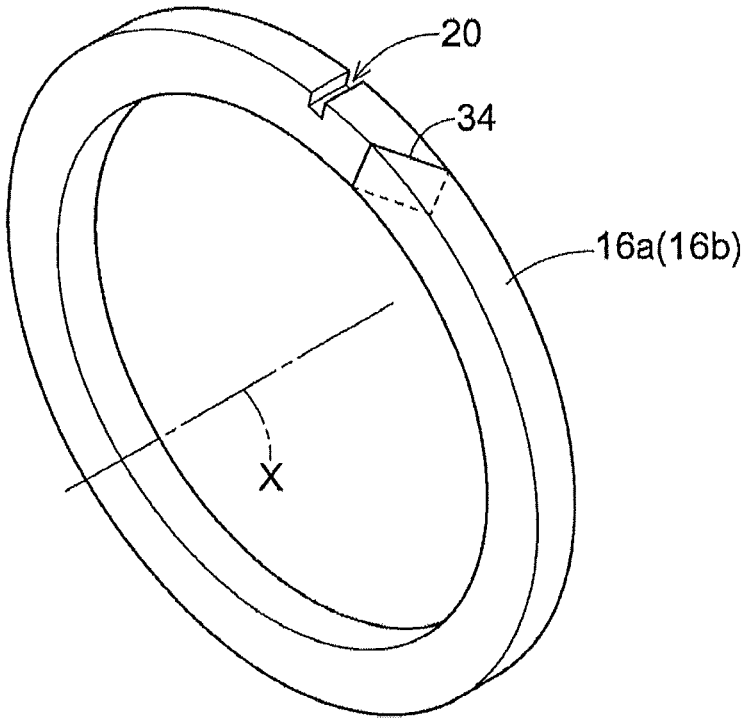
FIG. 6 is a perspective view of a seal ring according to a second embodiment.

FIG. 6 shows the seal rings 16*a*, 16*b* according to another embodiment of the present invention. Each of the seal rings 16*a*, 16*b* is formed in a C-shape having a gap 34 formed in a slanting direction relative to the rotational axis X and formed on a portion in the circumferential direction. As the communication passage 20 which is provided at each of annular seal rings 16*a*, 16*b* which define the both sides of the communication portion 19*b* for lock, a recessed groove formed in a quadrilateral shape in cross section which opens to the both sides in the direction of rotational axis X at a position separated from the gap 34 in the circumferential direction is formed at an outer peripheral side. Two communication passages 20 are provided as a series. Other constructions are similar to the first embodiment.

Third Embodiment

Figure 7:
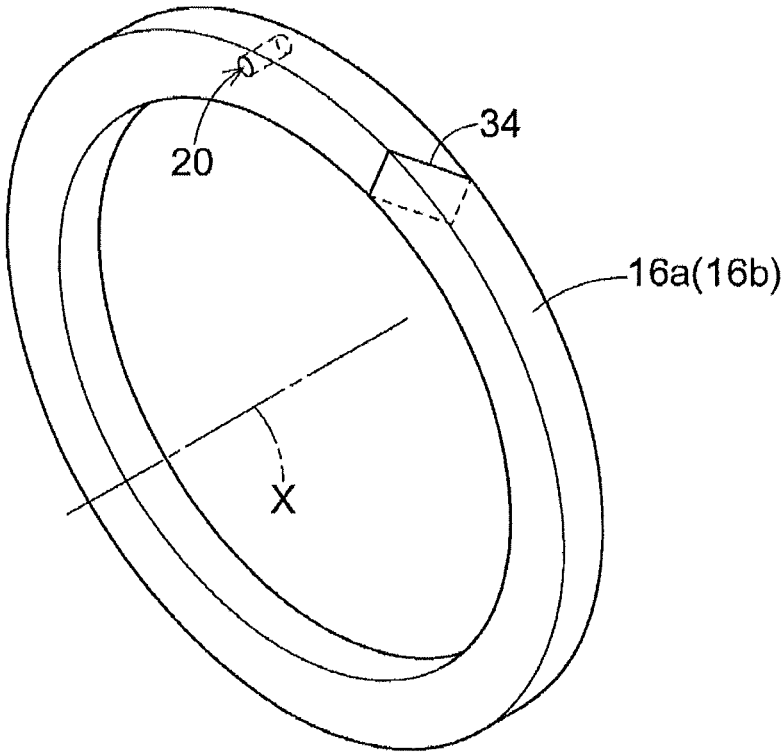
FIG. 7 is a perspective view of a seal ring according to a third embodiment.

FIG. 7 shows the seal rings 16*a*, 16*b* according to another embodiment of the present invention. Each of the seal rings 16*a*, 16*b* is formed in a C-shape having the gap 34 formed in a slanting direction relative to the rotational axis X and formed on a portion in the circumferential direction. As the communication passage 20 which is provided at each of annular seal rings 16*a*, 16*b*, a circular through hole which penetrates through the seal ring 16*a*, 16*b* to open to the both sides in the direction of rotational axis X is formed at a position separated from the gap 34 in the circumferential direction. Two communication passages 20 are provided as a series at a communication portion for lock side. Other constructions are similar to the first embodiment.

Other Embodiments

According to the variable valve timing control apparatus of the present invention, the communication passage 20 which is formed in a recessed and protruding configuration on a surface may be provided at the seal ring 16*a*, 16*b*. According to the variable valve timing control apparatus according to the present invention, the seal ring 16*a*, 16*b* may be formed in a C-shape in cross section including end surfaces 33 which face in a labyrinth manner each other at a portion in a circumferential direction, and the communication passage 20 may be formed with clearances formed by the end surfaces 33 facing each other in the labyrinth manner. According to the variable valve timing control apparatus of the present invention, as the communication passage 20 provided at the seal ring 16*a*, 16*b*, a recessed groove which opens to the both side in the direction of the rotational axis X may be formed at the outer peripheral side and at the inner peripheral side of the seal ring 16*a*, 16*b*, or may be formed at one of the outer peripheral side and the inner peripheral side of the seal ring 16*a*, 16*b*. According to the variable valve timing control apparatus of the present invention, as the communication passage 20 provided at the seal ring 16*a*, 16*b*, plural recessed grooves which open to the both sides in the rotational axis X direction may be formed with a distance from each other in the circumferential direction of the ring. According to the variable valve timing control apparatus of the present invention, as the communication passage 20 provided at the seal ring 16*a*, 16*b*, plural through holes penetrating through the seal ring 16*a*, 16*b* to open to the both sides in the rotational axis X direction may be formed with a distance from each other in the circumferential direction of the ring. According to the variable valve timing control apparatus of the present invention, a recessed groove or a through hole serving as the communication passage 20 may be formed on the annular seal rings 16*a*, 16*b* which are arranged to continue as a series in the circumferential direction. According to the variable valve timing control apparatus of the present invention, a communication passage which is constantly in communication with the both sides in the rotational axis direction may be formed at the seal ring which is positioned between the communication portion for advanced angle and the communication portion for retarded angle when the temperature of the pressurized fluid is within the temperature region which allows a control of the rotational phase. According to the variable valve timing control apparatus of the present invention, the driven side rotation member may include the advanced angle fluid passage, the retarded angle fluid passage, and the lock fluid passage which open to the rotational outer peripheral surface of the driven side rotation member, and the fixed member which is formed with the fixed inner peripheral surface coaxially facing the rotational outer peripheral surface of the driven side rotation member in a standstill state may include plural fluid passages which separately supply the pressurized fluid to the advanced angle fluid passage, the retarded angle fluid passage, and the lock fluid which open to the fixed inner peripheral surface.

The present invention is applicable to a variable valve timing control apparatus for various internal combustion engines such as a gasoline engine, diesel engine, or the like, other than an automobile.

The present invention is variable unless departing from the scope.

The invention claimed is:

1. A variable valve timing control apparatus, comprising:

a driving side rotation member synchronously rotating with a crankshaft of an internal combustion engine;

a driven side rotation member positioned to be coaxially rotatable relative to the driving side rotation member about a common rotational axis, synchronously rotating with a camshaft for opening and closing a valve of the internal combustion engine, and including a rotation peripheral surface;

a fluid pressure chamber formed between the driving side rotation member and the driven side rotation member;

an advanced angle chamber and a retarded angle chamber formed by dividing the fluid pressure chamber by a dividing portion provided at least one of the driving side rotation member and the driven side rotation member;

a phase control portion for controlling a rotational phase of the driven side rotation member relative to the driving side rotation member by supplying a pressurized fluid to the advanced angle chamber or to the retarded angle chamber;

an intermediate lock mechanism including a lock fluid passage allowing an inflow of the pressurized fluid and a lock member allowing a switching of a locked state where the rotational phase of the driven side rotation member is locked at an intermediate phase between a most retarded angle phase and a most advanced angle phase and an unlocked state where the locked state is released by a fluid pressure of the pressurized fluid flowing in from the lock fluid passage;

the driven side rotation member including an advanced angle fluid passage, which is in communication with the advanced angle chamber, a retarded angle fluid passage, which is in communication with the retarded angle chamber, and the lock fluid passage;

a fixed member formed with a fixed, peripheral surface facing the rotation peripheral surface of the driven side rotation member in a standstill state, positioned coaxially to an axis of the driven side rotation member, and including a plurality of fluid passages opening to the fixed peripheral surface to allow a supply of the pressurized fluid to an advanced angle fluid passage, a retarded angle fluid passage, and a lock fluid passage;

a plurality of seal rings each formed in an annular shape and positioned between the rotation peripheral surface of the driven side rotation member and the fixed peripheral surface of the fixed member, the seal rings positioned spaced apart from each other by a predetermined distance;

the advanced angle fluid passage, the retarded angle fluid passage, and the lock fluid passage are in communication with the corresponding fluid passages via a communication portion for advanced angle, a communication portion for retarded angle, and a communication portion for lock formed by annularly defining a void between the rotation peripheral surface and the fixed peripheral surface by the corresponding seal rings, respectively; wherein the seal ring sandwiched between two of the communication portion for advanced angle, the communication portion for retarded angle, and the communication portion for lock in a direction of the rotational axis among said plurality of seal rings includes a communication passage which establishes constant communication between both sides thereof in association with the direction of the rotational axis when temperature of the pressurized fluid is within a temperature range which allows a control of the rotational phase of the driven side rotation member.

2. The variable valve timing control apparatus according to claim 1, wherein each of the seal rings is formed in a C-shape including end surfaces facing each other at a portion in a circumferential direction, and the communication passage is defined by a clearance between the end surfaces.

3. The variable valve timing control apparatus according to claim 1, wherein the communication passage corresponds to a recessed groove formed on a portion of the seal ring at an outer side in a radial direction or at an inner side in a radial direction, and opposite side portions of the recessed groove in the direction of the rotational axis are open.

4. The variable valve timing control apparatus according to claim 1, wherein the communication passage corresponds to a through hole which is formed on the seal ring penetrating through the seal ring to open to the both sides in the direction of the rotational axis.

5. A variable valve timing control apparatus, comprising:

a driving side rotation member synchronously rotating with a crankshaft of an internal combustion engine;

a driven side rotation member positioned to be coaxially rotatable relative to the driving side rotation member about a common rotational axis, synchronously rotating with a camshaft for opening and closing a valve of the internal combustion engine, and including a rotation peripheral surface;

a fluid pressure chamber formed between the driving side rotation member and the driven side rotation member;

an advanced angle chamber and a retarded angle chamber formed by dividing the fluid pressure chamber by a dividing portion provided at least one of the driving side rotation member and the driven side rotation member;

a phase control portion for controlling a rotational phase of the driven side rotation member relative to the driving side rotation member by supplying a pressurized fluid to the advanced angle chamber or to the retarded angle chamber;

an intermediate lock mechanism including a lock fluid passage allowing an inflow of the pressurized fluid and a lock member allowing a switching of a locked state where the rotational phase of the driven side rotation member is locked at an intermediate phase between a most retarded angle phase and a most advanced angle phase and an unlocked state where the locked state is released by a fluid pressure of the pressurized fluid flowing in from the lock fluid passage;

the driven side rotation member including an advanced angle fluid passage, which is in communication with the advanced angle chamber, a retarded angle fluid passage, which is in communication with the retarded angle chamber, and the lock fluid passage;

a fixed member formed with a fixed peripheral surface facing the rotation peripheral surface of the driven side rotation member in a standstill state, positioned coaxially to an axis of the driven side rotation member, and including a plurality of fluid passages opening to the fixed peripheral surface to allow a supply of the pressurized fluid to an advanced angle fluid passage, a retarded angle fluid passage, and a lock fluid passage;

a plurality of seal rings each formed in an annular shape and positioned between the rotation peripheral surface of the driven side rotation member and the fixed peripheral surface of the fixed member, the seal rings positioned spaced apart from each other by a predetermined distance;

the advanced angle fluid passage, the retarded angle fluid passage, and the lock fluid passage are in communication with the corresponding fluid passages via a communication portion for advanced angle, a communication portion for retarded angle, and a communication portion for lock formed by annularly defining a void between the rotation peripheral surface and the fixed peripheral surface by the corresponding seal rings, respectively; wherein the seal ring sandwiched between two of the communication portion for advanced angle, the communication portion for retarded angle, and the communication portion for lock in a direction of the rotational axis among said plurality of seal rings includes a communication passage which establishes constant communication between both sides thereof in association with the direction of the rotational axis when temperature of the pressurized fluid is within a temperature range which allows a control of the rotational phase of the driven side rotation member; and a length of the seal ring at an outer portion in a radial direction is shorter than a length of the seal ring at an inner portion in a radial direction, and a void corresponding to a difference in the length corresponds to the communication passage.

6. The variable valve timing control apparatus according to claim 5, wherein each of the seal rings is formed in a C-shape including end surfaces facing each other at a portion in a circumferential direction, and the communication passage is defined by a clearance between the end surfaces.

7. The variable valve timing control apparatus according to claim 5, wherein the communication passage corresponds to a through hole which is formed on the seal ring penetrating through the seal ring to open to the both sides in the direction of the rotational axis.

8. The variable valve timing control apparatus according to claim 5, wherein the communication passage is formed only at the outer portion in a radial direction of the seal ring.

* * * * *